United States Patent [19]

Yokoyama

[11] Patent Number: 4,490,601

[45] Date of Patent: Dec. 25, 1984

[54] APPARATUS FOR MANUFACTURING METALLIC FINE PARTICLES USING AN ELECTRIC ARC

[75] Inventor: Tohei Yokoyama, Kyoto, Japan

[73] Assignee: Kabushiki Kaisha Hosokawa Funtai Kogaku Kenkyusho, Osaka, Japan

[21] Appl. No.: 469,668

[22] Filed: Feb. 25, 1983

[30] Foreign Application Priority Data

Mar. 5, 1982 [JP] Japan ..... 57-35610

[51] Int. Cl.[3] ..... B22F 9/10; B22F 9/14; B23P 1/06

[52] U.S. Cl. ..... 219/69 R; 264/8; 264/10; 425/6

[58] Field of Search ..... 219/69 R, 69 M, 68; 264/8, 10; 425/6, 8

[56] References Cited

U.S. PATENT DOCUMENTS

| | | | |
|---|---|---|---|
| 2,897,539 | 8/1959 | McMillan | 264/10 |
| 3,103,700 | 9/1963 | Halverson et al. | 425/8 |
| 3,963,812 | 6/1976 | Schlienger | 264/10 |
| 3,975,184 | 8/1976 | Akers | 264/10 |
| 4,218,410 | 8/1980 | Stephan et al. | 264/10 |
| 4,310,292 | 1/1982 | Carlson et al. | 264/8 |
| 4,408,971 | 10/1983 | Karinsky et al. | 425/8 |
| 4,435,342 | 3/1984 | Wentzell | 264/8 |

FOREIGN PATENT DOCUMENTS

| | | | |
|---|---|---|---|
| 2401723 | 4/1979 | France | 264/8 |

*Primary Examiner*—C. L. Albritton
*Assistant Examiner*—Geoffrey S. Evans
*Attorney, Agent, or Firm*—Edwin E. Greigg

[57] ABSTRACT

An apparatus for manufacturing metallic fine particles by use of at least one arc-discharging section located in a hollow interior cavity of a rotary body. Metallic material is dropped into the rotary body during rotation thereof. The metallic material is melted and driven centrifugally through an outlet where it impinges upon a stationary cooled wall of a surrounding casing. When the melted material strikes the cooled wall, the melted material forms small particles. These small particles are then withdrawn through an outlet in the casing.

6 Claims, 6 Drawing Figures

POWER SUPPLY
SEPARATOR
Hz
P

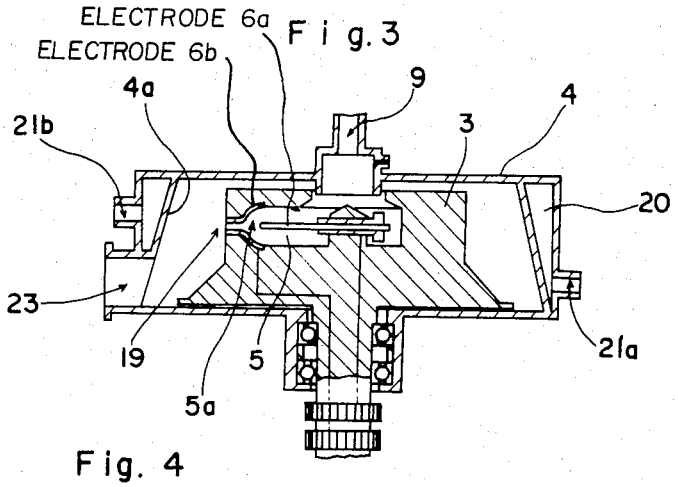
Fig. 3
Fig. 4
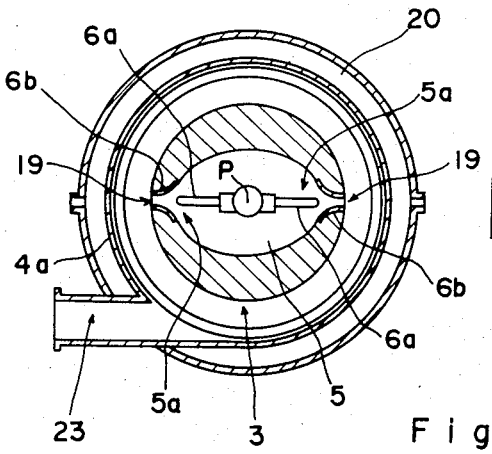
Fig. 5
(PRIOR ART)
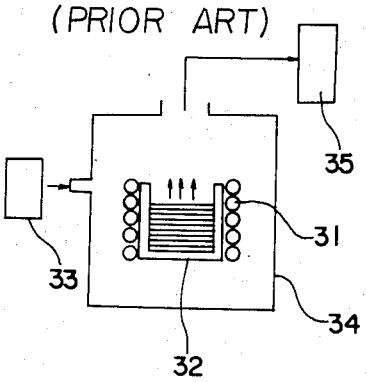
Fig. 6 (PRIOR ART)
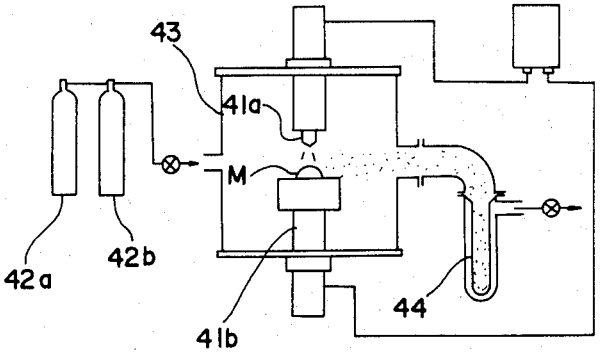

APPARATUS FOR MANUFACTURING METALLIC FINE PARTICLES USING AN ELECTRIC ARC

BACKGROUND OF THE INVENTION

This invention relates to an apparatus for manufacturing fine particles, of the particle size less than 50 microns, or more specifically ultrafine particles, of the particle size less than 1 micron, of a variety of metallic materials. More particularly, it relates to improvements of apparatuses for manufacturing metallic fine particles from any metallic material, having arc-discharging section(s) in which the material is heated and melted.

Metallic fine particles, and metallic ultrafine particles in particular, have had a lot of interest in recent years since they exhibit quite excellent properties entirely different from those of the normal metallic blocks, with respect to magnetic, optical, electrical, thermoconductive and the like properties, including reactivity and sinterability among others as are noted in particular, thus promising the possibility of utilization as excellent materials in a variety of the technical fields as in powder metallurgy, magnetics, catalysts, heat-proofing, cryogenics, welding, medicine and so forth.

However, there have as yet been no conventional apparatuses capable of manufacturing the metallic fine particles in continuous and effective mass production process, and thus keenly desired at present is the developement of such apparatuses, for the practical use as can manufacture the metallic fine particles on an industrial scale and at commercially paying costs.

Describing the further details, a couple of typical conventional apparatuses for manufacturing the metallic fine particles are as follows:

(a) Evaporation Type as shown in FIG. 5

A heater coil (31) melts a metal mass contained in a crucible (32) and causes same to evaporate. As ambient atmosphere therearound, an inert gas is sealingly introduced from a cylinder (33) into an overall casing (34) in which the evaporated metal is made into fine particles. A collector (35) is provided for withdrawing the metallic fine particles supplied thereto on the inert gas flow.

(b) Arc-Discharge Type As shown in FIG. 5.

Arc discharge between a pair of electrodes (41*a*),(41*b*)melts a lump of metal (M). As ambient atmosphere therearound, hydrogen from a cylinder (42*a*) and an inert gas from another cylinder (42*b*) are sealingly introduced into an overall casing (43) in which the melted metal is made into fine particles, as the hydrogen as once activatedly dissolved thereinto in high concentration in the arc-discharging process is again expelled and discharged therefrom as supersaturant in the deactivated normal condition. A collector (44) is provided for withdrawing the metallic fine particles supplied thereto on the gas flow.

However, both these conventional types of apparatuses (a),(b) have drawbacks in that they are batchwise in their operation as to the material metal and that treating or handling in large amounts is difficult and impractical since they are based on the principle of metal evaporation or hydrogen discharge, in either case of which the speed is rather categorically restrained by the controlling factors of temperature and pressure.

In view of the actual status as above, this invention has as its object to provide an apparatus capable of manufacturing the metallic fine particles in a continuous and mass-production process.

To attain the object, the apparatus for manufacturing metallic fine particles is according to this invention characterized in that:

the arc-discharging section(s) is(are) provided within a hollow interior cavity in a high-speed-driven type rotary body, a passage is provided for supplying therethrough the metallic material to the arc-discharging section(s) when the rotary body is driven in rotation, in a peripheral portion of the rotary body, radially outwardly of the arc-discharging section(s), there is(are) defined fine radial through hole(s) for centrifugally discharging therethrough the melted metallic material, radially outwardly of the rotary body, there is disposed, to define a confined space therebetween, an encasing stationary peripheral wall which is provided with a foced cooling means and which functions to cause the melted metallic material, as has discharged through the fine hole(s), to impinge thereagainst and to thereby be made into fine particles, and in the peripheral wall, there is provided a passage in communication with the space between the rotary body and this wall, thus with an inlet opening to the space, for withdrawing therethrough the metallic fine particles.

Function and merits accruing from the characteristic construction as above may be summarized in the following two items:

(1) The metallic material is supplied either fully continuously or somewhat intermittently through the supply passage to the arc-discharging section(s). As the material is melted there, it is made possible to centrifugally be ejected out at a high speed in a continuous way through the fine radial through hole(s) towards the peripheral wall in rotational angular distribution all over the entire wall periphery. Upon impingement against the forcedly cooled peripheral wall, the melted material is crushed into fine particles while being solidified at the same time. Thusly formed metallic fine particles may then be continuously withdrawn through the withdrawal passage. In this way, it is hereby made possible to realize practical continuous manufacturing of metallic fine particles, which has has been impossible with the convention apparatuses.

(2) Quite large centrifugal force on account of high speed rotation is available as the motive power for forcibly thrusting the melted material through the fine radial through hole(s). It is therefore possible to provide the radial through hole(s) in quite small diameter size and even then securely effecting therethrough the melted material at quite a high speed. As the melted material is thus crushed into fine particles upon vigorously shocking impingement against the peripheral wall, it has now been made possible to realize mass production of the metallic fine particles, or rather even ultrafine particles of less than 1 micron particle size.

In further conclusive expression, it is hereby made possible to complete an apparatus of enormous practical value as can manufacture, in continuous processing and with an innovatingly enhanced treating capacity, the metallic fine particles of extremely minute particle size, which are the focus of attention in recent years in quite a wide variety of industrial fields as the latent very useful material.

In a preferred embodiment of the apparatus for manufacturing metallic fine particles according to this invention, the rotary body has its lower peripheral portion in downwardly widening truncated conical slant shape to provide a smooth outgoing passage to the inlet of the withdrawing passage or near the same. Withdrawal of the product metallic fine particles is hereby made yet further smooth.

Still further preferred embodiments of the apparatus for manufacturing the metallic fine particles according to this invention and the advantages accruing therefrom will be apparent from the detailed description to follow hereunder.

BRIEF DESCRIPTION OF THE DRAWINGS

FIG. 3 is a view similar to a central portion of FIG. 1, here showing however a modified embodiment of the apparatus, FIG. 4 is a sectional view similar to FIG. 2, here showing however a further modified embodiment of the apparatus, and FIGS. 5 and 6 are schematic views of the respective different types of the conventional apparatuses.

DETAILED DESCRIPTION OF THE PREFERRED EMBODIMENTS

Figures 1, 2:
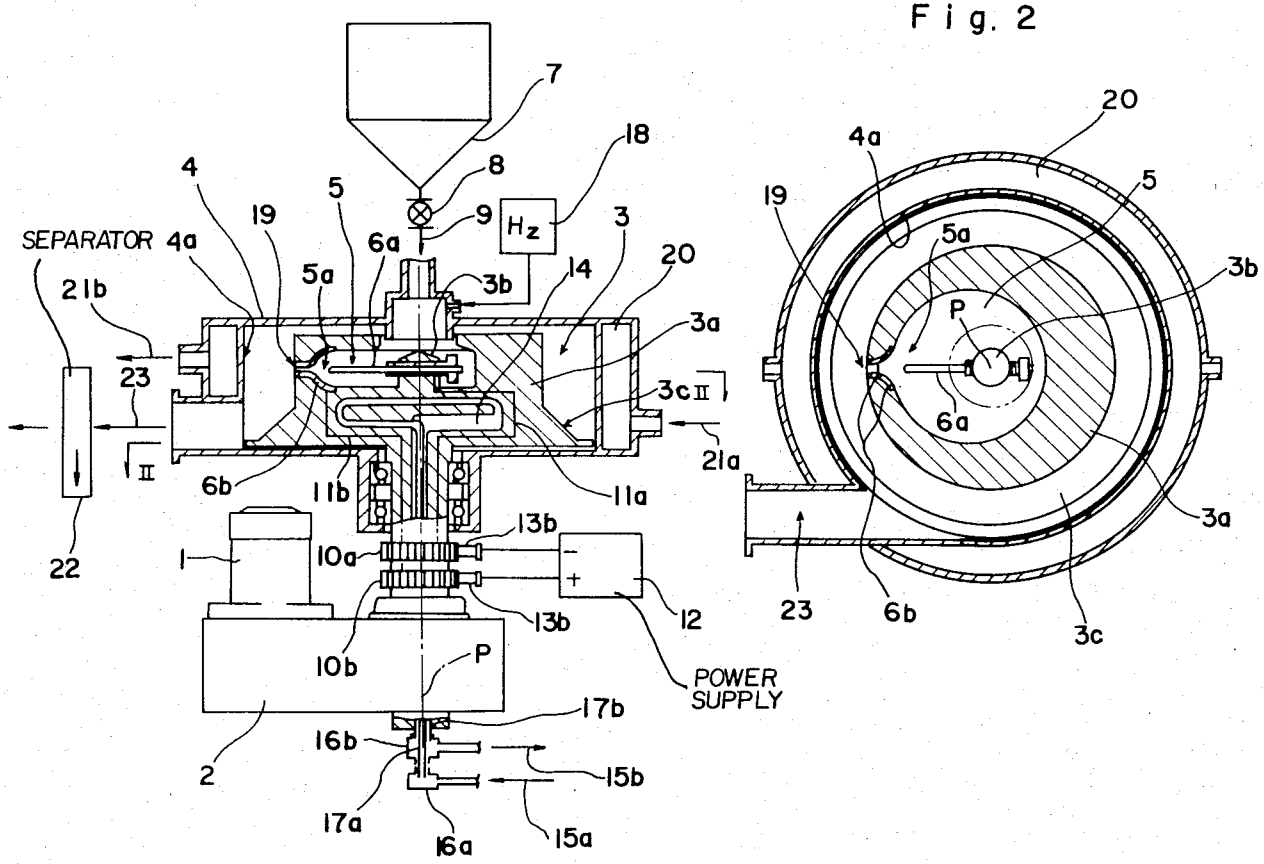
FIG. 1 is a schematic side elevation, partly in vertical section, of an apparatus for manufacturing metallic fine particles according to this invention.
FIG. 2 is a sectional view on a plane shown at II—II in FIG. 1.

Reference is first made to an embodiment of the apparaus shown in FIGS. 1 and 2.

An assembly of a prime mover (1) and a speed multiplier (2) is provided to drive a rotary body (3) in high speed rotation for instance somewhere around a range from 1,000 to 10,000 rpm. The rotary body (3) is made mainly of a heat-resisting material block (3*a*) such as a ceramic or the like, and is supported on bearings for rotation about a vertical axis (P) within a casing (4). The rotary body (3) has a hollow interior cavity (5) which is non-concentrically, thus laterally eccentrically, located with respect to the axis (P) and which is open upwards to the above towards the corresponding top portion of the casing (4). So as to provide an arc-discharging section (5*a*) within the cavity (5) at a portion thereof remotest from the axis (P), a pair of arc-discharging electrodes (6*a*),(6*b*) are disposed in such location. Above the casing (4) there is provided a material hopper (7) equipped with a constant rate feeder (8) and a further feed passage (9) through which the metallic material either in suitably sized lumps or preliminarily crushed granules is supplied into the cavity (5) and is ultimately heated and melted at the arc-discharging secton (5*a*). For this purpose, the feed passage (9) has its outlet end opposed above an upwardly pointed conical end (3*b*) of the rotary body (3) formed centrally on the axis (P), so that in consequence of the rotation of the rotary body (3) the metallic material may either fully continuously or somewhat intermittently be supplied from the feed passage (9) to the arc-discharging section (5*a*). The arc-discharging electrodes (6*a*),(6*b*) are electrically connected to a melting pair of conducting rings (10*a*),(10*b*), respectively, via the respectively associated individually separately embedded power lines (11*a*),(11*b*). The conducting rings (10*a*),(10*b*) are in turn individually separately rubbed by a mating pair of conducting brushes (13*a*),(13*b*) connected to a power source apparatus (12), so that the arc-discharging may in proper conformity be maintained either fully continuously or somewhat intermittently. The rotary body (3) further has another cavity functioning as a plenum (14) for circulating therethrough any suitable coolant fluid such as a gas, water or the like, for the purpose of preventing damage of the rotary body (3) from any possible overheating. For the coolant circulation, a feed pipe (15*a*) and a discharge pipe (15*b*) are attached and there are provided, to form up a through passage in connection thereto, the respectively associated rotary joints (16*a*),(16*b*) and embedded tubes or pipes (17*a*),(17*b*). One of the arc-discharging electrodes (6*a*) is mounted in a manner manually operable for adjustment in longitudinal protrusion and retraction, so that the gap between both the electrodes (6*a*),(6*b*) may at any time be adjusted to remain proper in spite of consumption of the electrode (6*a*). As a matter of course, it is as well possible to provide any suitable mechanism for automatically protruding such electrode (6*a*) in proper response to the consumption to always retain the proper gap between both the arc-discharging electrodes (6*a*),(6*b*). The casing (4) provides a hermetically sealed space around the rotary body (3), and for the purpose of filling the space with any one inert gas such as argon, helium or the like, or else with any mixture of such inert gases, in order to prevent oxidation of the metallic material, or else with some amount of hydrogen further added to such; there is provided, in connection to the casing (4), some proper means therefor as generally designated by a block at (18).

In a peripheral portion of the rotary body (3), radially outwardly of the arc-discharging portion (5*a*), there is defined a fine radial through hole (19), of the diameter for instance somewhere around a range from several microns to 3 mm, for discharging therethrough the metallic material melted in the arc-discharging section (5*a*), under the rotational centrifugal force. The casing (4) has its peripheral wall (4*a*) against which the melted metallic material ejectedly discharged from the fine radial through hole (19) comes to impinge. Radially directly outwardly of the peripheral wall (4*a*), fully surrounding the entire circular periphery thereof, there is formed a fluid plenum (20), thus in double wall construction. The fluid plenum (20) is equipped with respective connections to a feed passage (21*a*) and a discharge passage (21*b*) thus forming up a passage for circulation of any suitable coolant fluid such as water or the like. As the metallic material is thus vigorously crushed upon shocking impingement against the cooled peripheral wall (4*a*), while being at the same time thereby cooled in cooperation, it is expected to obtain solidified fine particles, preferably ultrafine particles of less than 1 micron particle size.

The casing (4) is equipped with a passage (23) for withdrawing therethrough the metallic fine particles, having a suitable solid-and-gas separator (22) of filter paper type of electrostatic dust collection type or the like as interposed therein, so that the particles may continuously be withdrawn from the space confined between the rotary body (3) and the peripheral wall (4*a*). In order to make smooth the withdrawal of the metallic fine particles, the rotary body (3) has its lower peripheral portion (3*c*) in downwardly widening truncated conical slant shape to provide a smooth outgoing passage leading to the withdrawing passage (23) inlet portion or near same.

The metallic material, as mentioned hereinabove as the object of this processing, may be of any kind such as:

any pure metal, as iron or any nonferrous metal; any alloy; or else any composite material with either a pure metal or an alloy as the base and including therein some additive ingredient(s) for instance as non-metallic element(s) as oxygen, nitrogen, carbon and the like, or compound(s) of metallic and non-metallic elements as metallic oxide(s), nitride(s), carbide(s) or the like.

Temperature of the ambient gas around the peripheral wall (4*a*) or the rotary body (3) may in any suitable manner be adjustably and properly set in accordance with the melting temperature of the metallic material actually used, such setting generally in most cases being sufficient somewhere around a temperature range lower than the melting temperature by 30 to 800° C.

Reference is now made to modified embodiments of the apparatus shown respectively in FIGS. 3 and 4.

As shown in FIG. 3, it may as well be possible to construct the rotary body (3) without any forced cooling means, thus to make same in sufficient thermo-mechanical strength only by proper selection or design of chracteristics of the heat-resisting material block (3*a*). The rotary body (3) may still further be modified in any suitable way as to its specific structural details, and it is also of no essential matter in what specific direction the rotary axis (P) actually extends.

Also as shown in FIG. 3, it is as well good to construct the peripheral wall (4*a*) in downwardly widening truncated conical shape, to contribute to a more rapidly and more smoothly discharging the metallic fine particles. Such wall may also be formed with a structure other than a component part of the overall casing, and may further as well be designed in any selection of a variety of structures and shapes.

In order to cool down the periphery wall (4*a*), any modified means may as well be used, for instance as annexedly installing any type of refrigerator or any cold source as the low-temperature liquefied gas supply source, and it is meant here that such may in the generic sense be referred to as forced cooling means (20).

As shown in FIG. 4, it may as well be possible to provide the single rotary body (3) with two pairs of arc-discharging electrodes (6*a*),(6*b*), thus with two spacedly apart arc-discharging sections (5*a*). It may still further be possible to provide same even with three or yet more arc-discharging sections (5*a*), whose positioning and configuration may also undergo a variety of modifications.

With regard to forming the fine through hole (19), also a variety of modifications are possible as to disposition and configuration, such as disposing a plurality of fine through holes (19) commonly and cooperatingly for a single arc-discharging section (5*a*), or contrary thereto disposing a single common fine through hole (19) to opposedly face a plurality of the arc-discharging sections (5*a*), and so forth.

The feed passage (9) for supplying therethrough the metallic material to the arc-discharging section(s) (5*a*), and also the passage (23) for withdrawing therethrough the metallic fine particles from the space confined between the rotary body (3) and the peripheral wall (4*a*), may as well be respectively modified in any arbitrary design as to their specific structural details, configuration and also number, not limited to be only single as in the illustrated and hereinbefore-described specific embodiments.

I claim:

1. An apparatus for manufacturing metallic fine particles from a metallic material, having at least one arc-discharging section in which the material is heated and melted, the apparatus comprising a rotary body, a hollow interior cavity in said body, at least one arc-discharging section in said hollow interior cavity of said rotary body, means for rotating said rotary body at a high rotational speed, a passage in said rotary body for supplying therethrough said metallic material to said at least one arc-discharging section during rotation of said rotary body, a fine radially extending aperture in a peripheral portion of said rotary body radially of said at least one arc-discharging section through which melted metallic material is centrifugally discharged, a stationary casing surrounding said rotary body which forms a confined space about said rotary body, said casing including a cooled stationary wall upon which melted metallic material centrifugally discharged through said aperture in said body impinges to thereby form fine particles, cooling means for cooling said stationary wall, and an outlet passage in said stationary wall of said casing through which said fine particles formed in said casing are withdrawn.

2. An apparatus as set forth in claim 1, in which said rotary body includes a lower peripheral portion thereof extending in a downwardly widening truncated conical slant shape to provide a smooth outgoing passage leading to said outlet passage in said casing.

3. An apparatus as set forth in claim 2, in which said stationary wall of said casing has a periphery in a downwardly widening slant shape.

4. An apparatus as set forth in claim 3, which includes a plurality of arc-discharging sections, and a plurality of fine radially extending apertures in said rotary body.

5. An apparatus as set forth in claim 4, in which said rotary body is provided with a forced cooling means.

6. An apparatus as set forth in claim 4 in which said casing is provided with an enclosed wall through which a coolant is directed.

* * * * *